US011261612B2

(12) United States Patent
Tao

(10) Patent No.: US 11,261,612 B2
(45) Date of Patent: Mar. 1, 2022

(54) INFLATABLE SWIMMING POOL CONVENIENT FOR DRAINAGE

(71) Applicant: Qingping Tao, Enshi Autonomous Prefecture (CN)

(72) Inventor: Qingping Tao, Enshi Autonomous Prefecture (CN)

( * ) Notice: Subject to any disclaimer, the term of this patent is extended or adjusted under 35 U.S.C. 154(b) by 61 days.

(21) Appl. No.: 16/988,742

(22) Filed: Aug. 10, 2020

(65) Prior Publication Data

US 2021/0095487 A1 Apr. 1, 2021

(51) Int. Cl.
*E04H 4/00* (2006.01)

(52) U.S. Cl.
CPC ..... *E04H 4/0025* (2013.01)

(58) Field of Classification Search
CPC ..... E04H 4/0025
USPC ..... 4/506
See application file for complete search history.

(56) References Cited

U.S. PATENT DOCUMENTS

2002/0157178 A1* 10/2002 Sejnowski ..... E04H 4/0025 4/506
2004/0040083 A1* 3/2004 Bentley ..... A47K 3/06 4/585
2018/0160820 A1* 6/2018 Hsu ..... F04B 35/04

* cited by examiner

*Primary Examiner* — Tuan N Nguyen

(57) ABSTRACT

The present invention provides an inflatable swimming pool convenient for drainage, which comprises an air chamber layer and a bottom pad. The air chamber layer defines an approximate rectangle with two long sides of the rectangular air chamber layer recessed inwards. The bottom of the air chamber layer is closed at a bottom plane by the bottom pad to form a pool structure, and after water is filled between the air chamber layer and the bottom pad, the two long sides of the air chamber layer can expand outwards to form a straight rectangular pool. An accommodating chamber is further arranged in the air chamber layer. The air pump is communicated with an inner cavity of the air chamber layer through an inflation communication pipe. The inflatable swimming pool of the present invention is more convenient to use, has better drainage efficiency and can be inflated automatically.

7 Claims, 3 Drawing Sheets

INFLATABLE SWIMMING POOL CONVENIENT FOR DRAINAGE

FIELD OF THE INVENTION

The invention relates to the technical field of inflatable swimming pools, and in particular to an inflatable swimming pool convenient for drainage.

BACKGROUND OF THE INVENTION

With the progress of society, the individual's requirements for the quality of life are improved step by step. Inflatable swimming pools are light in weight and easy to carry, and can be used in various occasions, such as small parks, roadsides, homes, etc., to meet the water entertainment needs of families and children. There are many common inflatable swimming pools on the market, but there are still some defects in use, such as incomplete drainage, poor safety and poor flexibility. Moreover, due to material problems, the swimming pools are easily damaged and the waste of water is also serious.

The swimming pools in the prior art are usually of a one-piece fixed structure, which cannot be folded when not in use, resulting in a large occupied space. In addition, there are also some inflatable swimming pools in the prior art, but the bottom of the existing inflatable swimming pools is usually of a fixed structure too, which also have the problem of drainage. Usually, only a drainage port is opened at a side wall of the swimming pool or an enlarged drainage pipe is arranged at one side, but the drainage effect is insignificant, and it is easy to cause dirty water to deposit at the bottom of the swimming pool, causing the growth of bacteria and affecting the health of users.

In addition, the existing swimming pools are straight after being inflated, and protrude outwards after being filled with water, which affects the appearance, occupies a larger area, and has certain limitations in use. When inflating the inflatable air chamber, it needs to be inflated manually, which is time-consuming and labor-intensive. When using an air pump, it will needs to pull the electric wire, which is troublesome to operate and extremely inconvenient to use.

There is a need for a new inflatable swimming pool featuring convenient use, better drainage efficiency and convenient inflation, which can solve the above problems.

SUMMARY OF THE INVENTION

The present invention provides an inflatable swimming pool convenient for drainage, which solves the problem that an existing swimming pool is not convenient enough to use through technical transformation of an existing inflatable swimming pool apparatus.

To solve the above technical problems, the present invention specifically adopts the following technical solution:

An inflatable swimming pool convenient for drainage includes an air chamber layer and a bottom pad, wherein the air chamber layer defines an approximate rectangle with two long sides of the rectangular air chamber layer recessed inwards, the bottom of the air chamber layer is closed at a bottom plane by the bottom pad to form a pool structure, and after water is filled between the air chamber layer and the bottom pad, the two long sides of the air chamber layer can expand outwards to form a straight rectangular pool, an accommodating chamber is further arranged in the air chamber layer, a closing cover is arranged outside the accommodating chamber, a power supply module, a control switch and an air pump are arranged in the accommodating chamber, the air pump is communicated with an inner cavity of the air chamber layer through an inflation communication pipe, and the control switch can control the air pump to be turned on or off.

Preferably, the air chamber layer includes an upper air chamber, a middle air chamber and a lower air chamber each provided with an inflation nozzle on an outer wall thereof, and the accommodating chamber is arranged at the lower air chamber.

Preferably, an upper vent port is arranged between the upper air chamber and the middle air chamber, a middle vent port is arranged between the middle air chamber and the lower air chamber, and the air pump in the accommodating chamber is communicated with the lower air chamber through a lower inflation port arranged at a tail end of the inflation communication pipe.

Preferably, the inflation nozzle includes a base, a rubber protective sleeve, a connecting strap, a middle plug and a top plug, wherein the rubber protective sleeve is disposed on the base and is provided with a first vent hole in the middle, the periphery of an upper end of the first vent hole is connected with the middle plug and the top plug through the connecting strap, a lower end of the middle plug can close the first vent hole, an upper part of the middle plug is further provided with a second vent hole, a one-way valve is arranged between the second vent hole and the bottom of the middle plug, and a lower end of the top plug can close the second vent hole.

Preferably, the one-way valve includes an elastic valve plate and a limiting block, wherein a mounting hole is formed in the center of the bottom of the middle plug, and a plurality of through holes are formed around the mounting hole, a middle part of the elastic valve plate protrudes through the mounting hole and is connected with the limiting block in the second vent hole of the middle plug, the limiting block is used for preventing the elastic valve plate from separating from the middle plug, and the elastic valve plate can be pushed by air flow to open or close the through holes.

Preferably, the bottom pad is divided into three layers, which are an upper PVC layer, a middle EVA sponge layer and a lower PVC layer from top to bottom.

Preferably, the bottom pad is also provided with an openable/closable drainage port, which is also communicated with a drainage pipe arranged at the bottom of the bottom pad, and the drainage pipe extends out of the air chamber layer.

Compared with the prior art, the present invention has the following beneficial effects:

In the existing design, the side edges of the swimming pool are straight after inflation, and the swimming pool will protrude outwards after being filled with water. In the present invention, the side walls of the swimming pool are designed to be recessed inwards, and will expand to form a straight square after the swimming pool is filled with water.

The inflation nozzle of the present invention is designed to be higher than an inflation nozzle of an existing swimming pool which will pop out under water pressure after the swimming pool is filled with water, so that by being designed to be higher, the inflation nozzle is not easy to pop out after being pressed into the air chamber.

According to the invention, an electric air pump is arranged inside the air chamber, and the air pump can perform automatic inflating by installing a power supply component, thereby meeting the needs of outdoor use.

The bottom pad of the present invention has a three-layer design, but in the prior art, there is only a single layer of PVC material. The bottom pad of the present invention is sequentially provided with an upper PVC layer, a middle EVA sponge layer, and a lower PVC layer from top to bottom. The EVA sponge is foamed from polyene brilliant plastic, also known as foam, and does not contain any toxic substances harmful to human body. In addition, the EVA sponge is flexible, light in weight, good in density and elastic, and can be used as a buffer material to absorb and disperse external impact force to protect the product. At the same time, the EVA sponge has a series of excellent use characteristics such as heat preservation, moisture resistance and corrosion resistance. The use of the EVA sponge in the bottom pad makes the bottom pad feel better to touch and more comfortable to step on.

Figure 1:
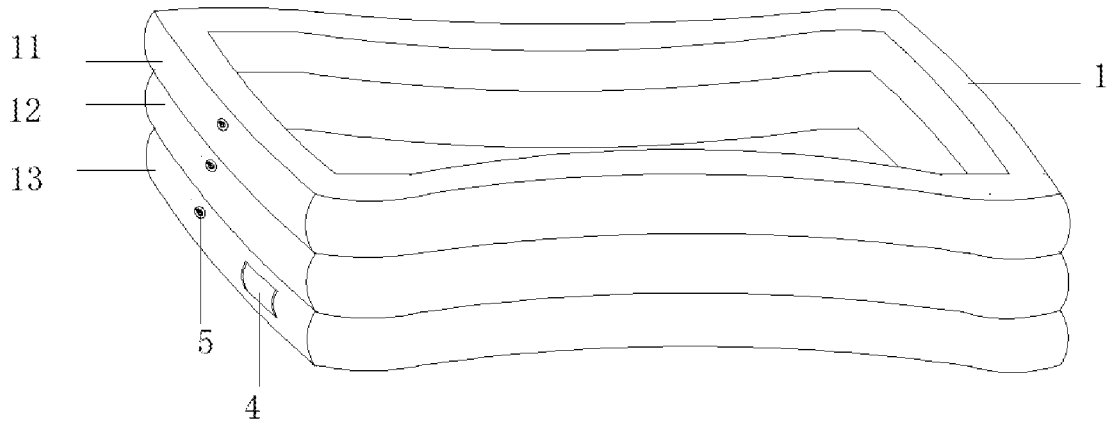
FIG. 1 is a schematic perspective view of the present invention.

Reference numerals: air chamber layer 1, upper air chamber 11, middle air chamber 12, lower air chamber 13, upper vent port 14, middle vent port 15, bottom pad 2, upper PVC layer 21, middle EVA sponge layer 22, lower PVC layer 23, drainage port 24, drainage pipe 25, accommodating chamber 3, power supply module 31, control switch 32, air pump 33, inflation communication pipe 34, lower inflation port 341, closing cover 4, inflation nozzle 5, base 51, rubber protective sleeve 52, connecting strap 53, middle plug 54, mounting hole 541, through hole 54, top plug 55, first vent hole 56, second vent hole 57, one-way valve 58, elastic valve plate 581, and limiting block 582.

DETAILED DESCRIPTION OF THE PREFERRED EMBODIMENT

The specific content of the present invention will be described in detail with reference to the drawings and embodiments.

Figure 2:
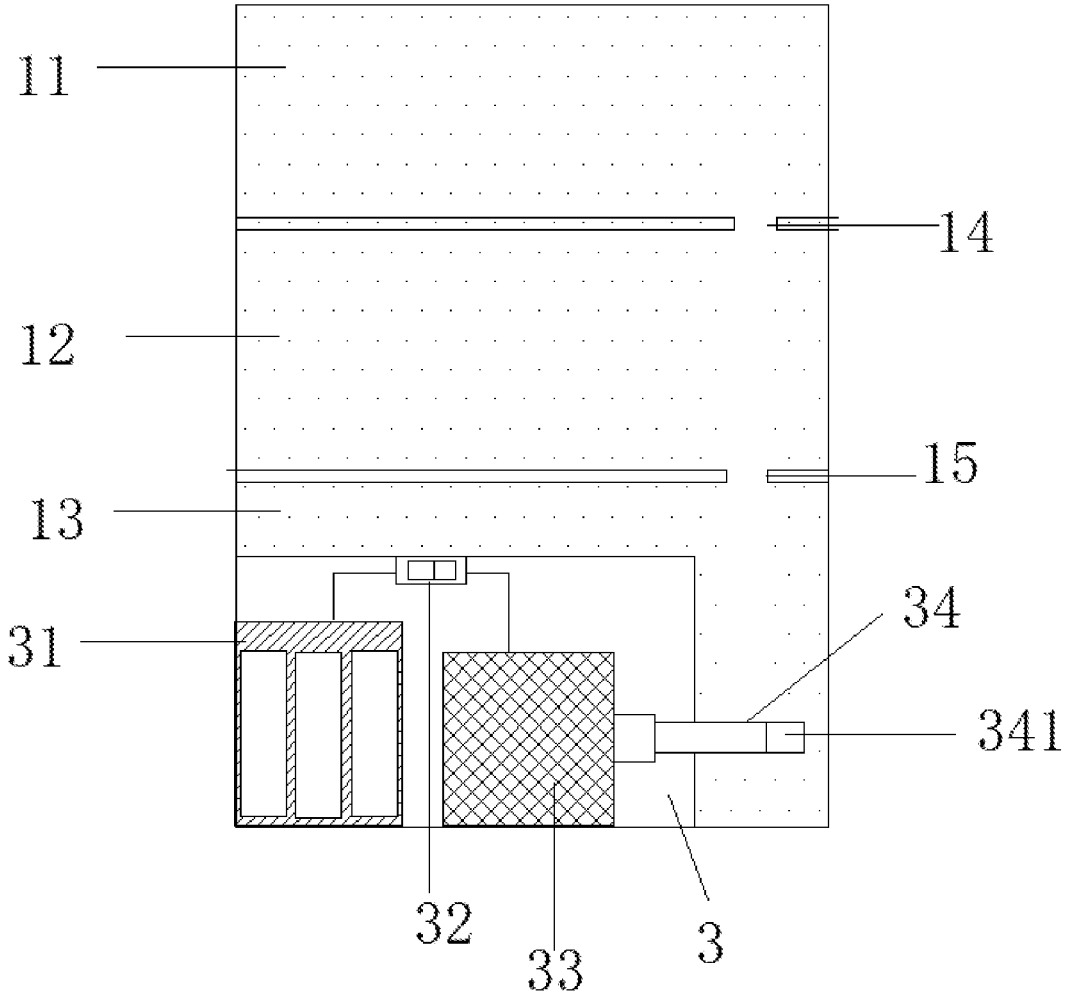
FIG. 2 is a schematic diagram showing arrangement of an air pump in an accommodating chamber of the present invention.
Figure 3:
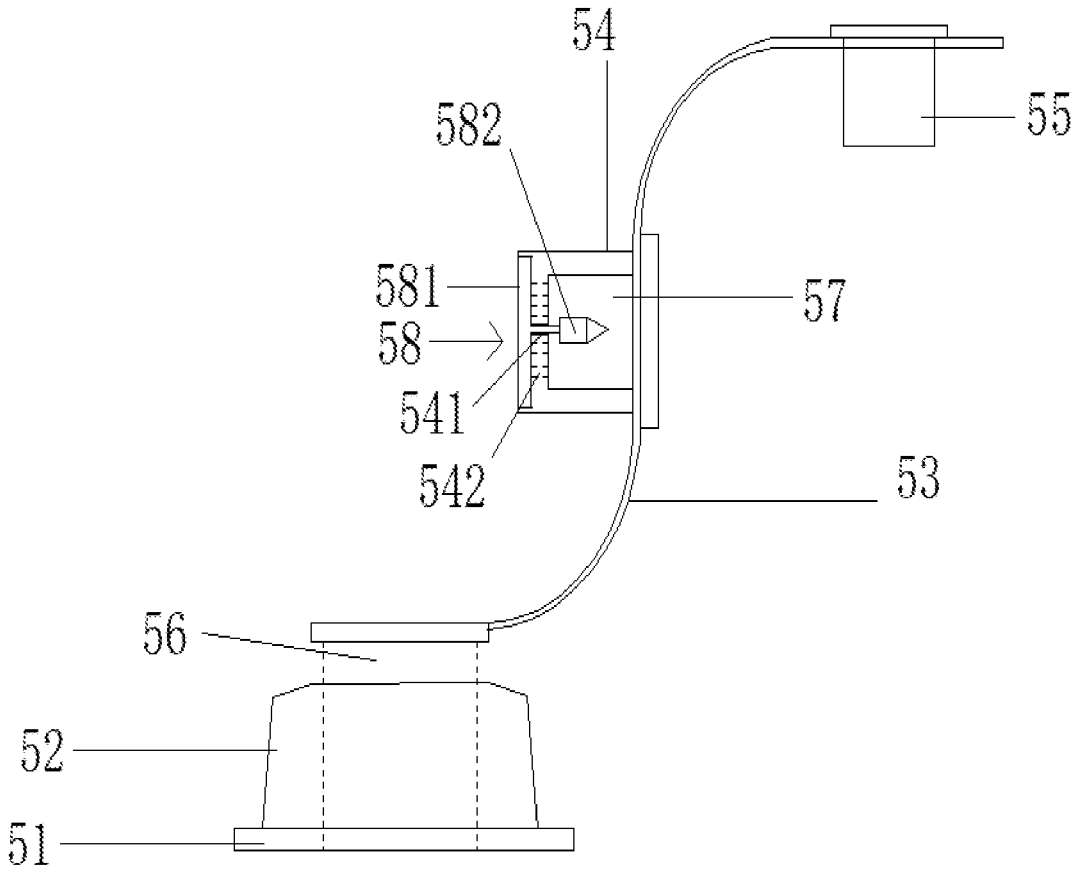
FIG. 3 is a schematic diagram of an inflation nozzle of the present invention.
Figure 4:
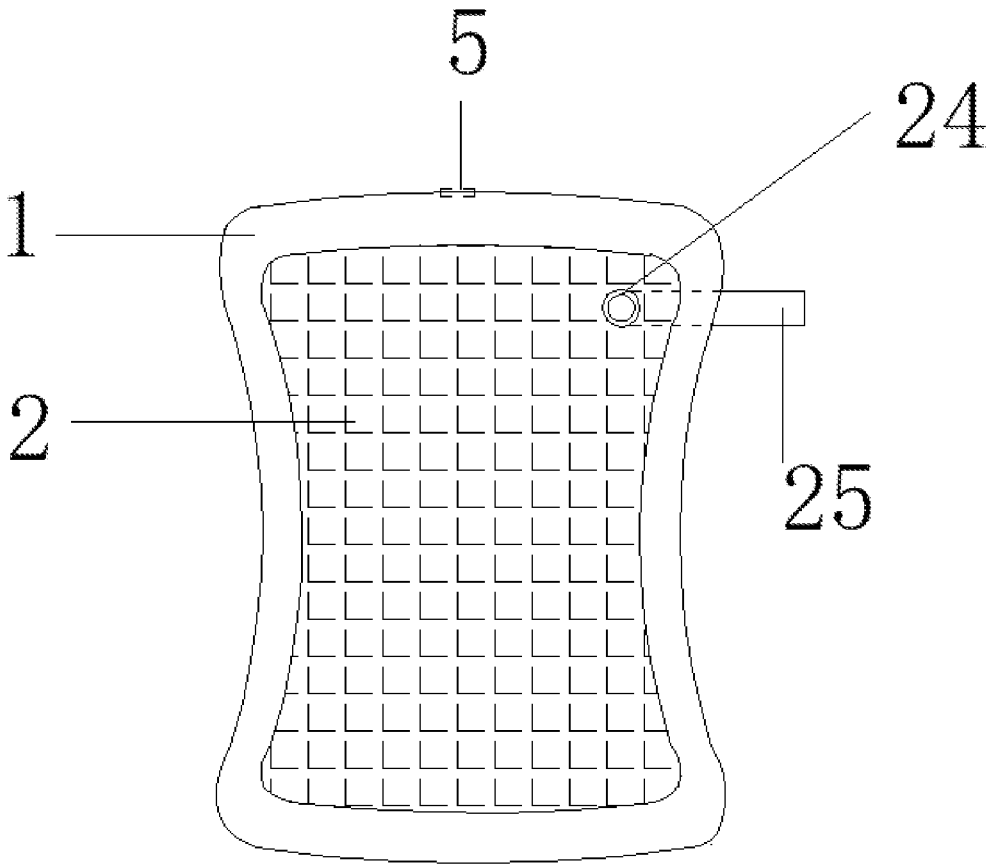
FIG. 4 is a top view of the present invention.
Figure 5:
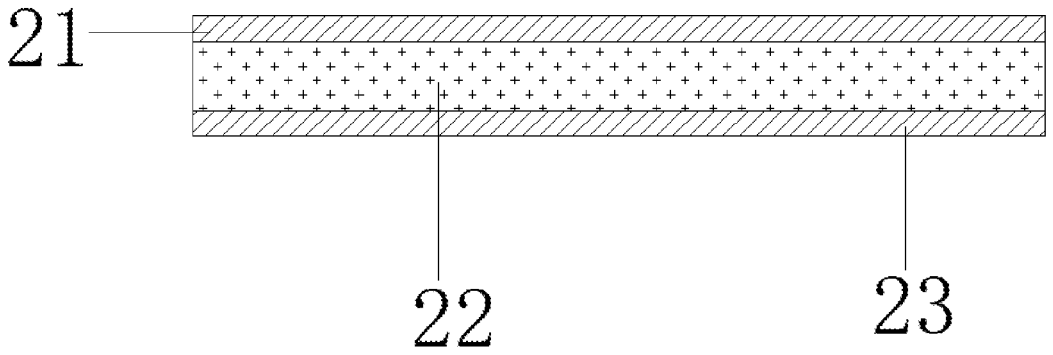
FIG. 5 is a schematic diagram showing layers of a bottom pad of the present invention.

As shown in FIGS. 1-5, in this embodiment, an inflatable swimming pool convenient for drainage is provided, which includes an air chamber layer 1 and a bottom pad 2. The air chamber layer 1 defines an approximate rectangle with two long sides of the rectangular air chamber layer 1 recessed inwards. The bottom of the air chamber layer 1 is closed at a bottom plane by the bottom pad 2 to form a pool structure, and after water is filled between the air chamber layer 1 and the bottom pad 2, the two long sides of the air chamber layer 1 can expand outwards to form a straight rectangular pool. An accommodating chamber 3 is further arranged in the air chamber layer 1. A closing cover 4 is arranged outside the accommodating chamber 3. A power supply module 31, a control switch 32 and an air pump 33 are arranged in the accommodating chamber 3. The air pump 33 is communicated with an inner cavity of the air chamber layer 1 through an inflation communication pipe 34. The control switch 32 can control the air pump 33 to be turned on or off.

The air chamber layer 1 has a thickness increased from a traditional thickness of 0.28 mm to 0.40 mm. With the increase in the thickness of the product, the quality of the product is also improved, making the product less likely to be damaged and more durable.

Further, in order to facilitate the installation of the power module 31, the control switch 32 and the air pump 33, the air chamber layer 1 includes an upper air chamber 11, a middle air chamber 12 and a lower air chamber 13 of PVC layer 23 each provided with an inflation nozzle 5 at an outer wall thereof. The accommodation chamber 3 is arranged at the lower air chamber 13 of PVC layer 23. The power module 31 can use a rechargeable battery, which is convenient for installation, disassembly and replacement. The inflating nozzles 5 are respectively arranged on upper sides of the outer walls of the upper air chamber 11, the middle air chamber 12 and the lower air chamber 13 of PVC layer 23.

Further, in order to allow the upper air chamber 11, the middle air chamber 12 and the lower air chamber 13 of PVC layer 23 to be fully inflated at the same time when the air pump 33 inflates, an upper vent port 14 is formed between the upper air chamber 11 and the middle air chamber 12, and a middle vent port 15 is formed between the middle air chamber 12 and the lower air chamber 13 of PVC layer 23. The air pump 33 in the accommodating chamber 3 is communicated with the lower air chamber 13 of PVC layer 23 through an inflation port of the lower PVC layer 23 arranged at a tail end of the inflation communication pipe 34.

Further, in order to obtain a better use experience, inflation and deflation can both be performed at the inflation nozzle 5. The inflation nozzle 5 includes a base 51, a rubber protective sleeve 52, a connecting strap 53, a middle plug 54 and a top plug 55. The rubber protective sleeve 52 is disposed on the base 51. A first vent hole 56 is formed in the middle of the rubber protective sleeve 52. The periphery of an upper end of the first vent hole 56 is connected with the middle plug 54 and the top plug 55 through the connecting strap 53. A lower end of the middle plug 54 can close the first vent hole 56. An upper part of the middle plug 54 is further provided with a second vent hole 57. A one-way valve 58 is arranged between the second vent hole 57 and the bottom of the middle plug 54. A lower end of the top plug 55 can close the second vent hole 57. When using a large-aperture air pump, the middle plug 54 is opened to directly inflate the first vent hole 56. After the middle plug 54 is closed, a smaller-aperture air pump may be used to inflate the air chamber from the second vent hole 57, and because of the design of the one-way valve 58, air cannot escape from the second vent hole 57 in a reverse direction. The inflation nozzle 5 can also trap the middle plug 54 and the top plug 55 into the rubber protective sleeve 52 after being pressed, and an outer surface of the inflation nozzle 5 is flush with an outer wall of the air chamber layer 1.

Further, in order to achieve the effect of controlling one-way air flow through the one-way valve 58, the one-way valve 58 includes an elastic valve plate 581 and a limiting block 582. A mounting hole is formed in the center of the bottom of the middle plug 54, and a plurality of through holes 542 are formed around the mounting hole 541. A middle part of the elastic valve plate 581 protrudes through the mounting hole 541 and is connected with the limiting block 582 in the second vent hole 57 of the middle plug 54. The limiting block 582 is used to prevent the elastic valve plate 581 from separating from the middle plug 54, and the elastic valve plate 581 can be pushed by air flow to open or close the through holes 542.

Further, in order to obtain better comfort, the bottom pad 2 is divided into three layers, which are an upper PVC layer 21, a middle EVA sponge layer 22 and a lower PVC layer 23 from top to bottom. The EVA sponge is foamed from polyethylene plastic, also known as foam, and does not contain any toxic substances harmful to human body. In addition, the EVA sponge is flexible, light in weight, good in density and elastic, and can be used as a buffer material to absorb and disperse external impact force to protect the product. At the same time, the EVA sponge has a series of excellent use characteristics such as heat preservation, moisture resistance and corrosion resistance. The use of the EVA sponge in the bottom pad makes the bottom pad feel better to touch and more comfortable to step on.

Further, in order to obtain better drainage efficiency, the bottom pad 2 is also provided with an openable/closable drainage port 24, which is also communicated with a drainage pipe 25 arranged at the bottom of the bottom pad 2, and the drainage pipe 25 extends out of the air chamber layer 1.

Further, in order to enrich the playing methods of the swimming pool, matching inflatable toys, such as inflatable dolls, slides, parasols, swimming rings, etc., can also be arranged at an upper end of the swimming pool air chamber, which makes playing in the swimming pool more interesting.

In this embodiment, side walls of the swimming pool are designed to be recessed inwards, and will expand to form a straight square after the swimming pool is filled with water. The inflation nozzle 5 in this embodiment is designed to be higher than an inflation nozzle of an existing swimming pool which will pop out under water pressure after the swimming pool is filled with water, so that by being designed to be higher, the inflation nozzle is not easy to pop out after being pressed into the air chamber. In this embodiment, an electric air pump 33 is arranged inside the air chamber, and the air pump 33 can perform automatic inflating by installing a power supply component, thereby meeting the needs of outdoor use. The bottom pad of in this embodiment has a three-layer design, but in the prior art, there is only a single layer of PVC material. The bottom pad of the present invention is sequentially provided with an upper PVC layer, a middle EVA sponge layer, and a lower PVC layer from top to bottom. The EVA sponge is foamed from polyene brilliant plastic, also known as foam, and does not contain any toxic substances harmful to human body. In addition, the EVA sponge is flexible, light in weight, good in density and elastic, and can be used as a buffer material to absorb and disperse external impact force to protect the product. At the same time, the EVA sponge has a series of excellent use characteristics such as heat preservation, moisture resistance and corrosion resistance. The use of the EVA sponge in the bottom pad makes the bottom pad feel better to touch and more comfortable to step on.

Finally, it should be noted that the above embodiments are only used to illustrate the technical solution of the present invention, but not to limit it. Although the present invention has been described in detail with reference to the preferred embodiments, those of ordinary skill in the art should understand that modifications or equivalent replacements may be made to the technical solution of the present invention without departing from the purpose and scope of the technical solution of the present invention, which should be covered by the claims of the present invention.

The standard parts used in the present invention can be purchased from the market, the special-shaped parts can be customized according to the description and the accompanying drawings, and the concrete connection of each part adopts the bolts and rivets mature in the prior art. Conventional means such as welding, machinery, parts and equipment are of conventional models in the prior art, and the circuit connection adopts conventional connection methods in the prior art, which will not be described in detail here.

In the description of the present invention, unless otherwise specified and limited, the terms "installed", "coupled", "connected" and "fastened" shall be broadly interpreted to mean elements that are coupled or connected to other elements either fixedly, detachably or integrally; or coupled or connected to other elements mechanically or electrically; or coupled or connected to other elements directly or through an intermediate medium; or refer to the internal communication of two elements or the interaction between two elements. For those skilled in the art, the specific meanings of the above terms in the present invention can be understood in specific situations.

The invention claimed is:

1. An inflatable swimming pool convenient for drainage, comprising an air chamber layer and a bottom pad, wherein the air chamber layer defines an approximate rectangle with two long sides of the rectangular air chamber layer recessed inwards, the bottom of the air chamber layer is closed at a bottom plane by the bottom pad to form a pool structure, and after water is filled between the air chamber layer and the bottom pad, the two long sides of the air chamber layer can expand outwards to form a straight rectangular pool, an accommodating chamber is further arranged in the air chamber layer, a closing cover is arranged outside the accommodating chamber, a power supply module, a control switch and an air pump are arranged in the accommodating chamber, the air pump is communicated with an inner cavity of the air chamber layer through an inflation communication pipe, and the control switch can control the air pump to be turned on or off.

2. The inflatable swimming pool convenient for drainage according to claim 1, wherein the air chamber layer comprises an upper air chamber, a middle air chamber and a lower air chamber each provided with an inflation nozzle on an outer wall thereof, and the accommodating chamber is arranged at the lower air chamber.

3. The inflatable swimming pool convenient for drainage according to claim 2, wherein an upper vent port is arranged between the upper air chamber and the middle air chamber, a middle vent port is arranged between the middle air chamber and the lower air chamber, and the air pump in the accommodating chamber is communicated with the lower air chamber through a lower inflation port arranged at a tail end of the inflation communication pipe.

4. The inflatable swimming pool convenient for drainage according to claim 2, wherein the inflation nozzle includes a base, a rubber protective sleeve, a connecting strap, a middle plug and a top plug, the rubber protective sleeve is disposed on the base and is provided with a first vent hole in the middle, the periphery of an upper end of the first vent hole is connected with the middle plug and the top plug through the connecting strap, a lower end of the middle plug can close the first vent hole, an upper part of the middle plug is further provided with a second vent hole, a one-way valve is arranged between the second vent hole and the bottom of the middle plug, and a lower end of the top plug can close the second vent hole.

5. The inflatable swimming pool convenient for drainage according to claim 4, wherein the one-way valve includes an elastic valve plate and a limiting block, a mounting hole is formed in the center of the bottom of the middle plug, and a plurality of through holes are formed around the mounting hole, a middle part of the elastic valve plate protrudes through the mounting hole and is connected with the limiting block in the second vent hole of the middle plug, the limiting block is used for preventing the elastic valve plate from separating from the middle plug, and the elastic valve plate can be pushed by air flow to open or close the through holes.

6. The inflatable swimming pool convenient for drainage according to claim 1, wherein the bottom pad is divided into three layers, which are an upper PVC layer, a middle EVA sponge layer and a lower PVC layer from top to bottom.

7. The inflatable swimming pool convenient for drainage according to claim 1, wherein the bottom pad is also provided with an openable/closable drainage port which is also communicated with a drainage pipe arranged at the bottom of the bottom pad, and the drainage pipe extends out of the air chamber layer.

* * * * *